United States Patent [19]

Scelba

[11] Patent Number: 4,679,419

[45] Date of Patent: Jul. 14, 1987

[54] FRONT-PROGRAMMABLE COMBINATION LOCK WITH MOVABLE FACEPLATE

[75] Inventor: Stephen S. Scelba, Clifton, N.J.

[73] Assignee: Presto Lock, Inc., Garfield, N.J.

[21] Appl. No.: 855,639

[22] Filed: Apr. 25, 1986

[51] Int. Cl.[4] ..... E05B 37/02

[52] U.S. Cl. ..... 70/312; 70/316

[58] Field of Search ..... 70/312, 315, 316, 317, 70/318

[56] References Cited

U.S. PATENT DOCUMENTS

| | | | |
|---|---|---|---|
| 3,952,561 | 4/1976 | Bako | 70/70 |
| 4,123,923 | 11/1978 | Bako | 70/74 |
| 4,389,863 | 6/1983 | Bako | 70/312 |
| 4,441,346 | 4/1984 | Castiglioni | 70/312 |

*Primary Examiner*—Robert L. Wolfe

*Attorney, Agent, or Firm*—Shapiro and Shapiro

[57] ABSTRACT

A combination lock has a faceplate movable from a first position to a second position only when combination dials are set to an opening combination of the lock, the dials being movable with the faceplate portion from the first position to the second position and being rotatable relative to the faceplate. A spring biases the faceplate portion toward the first position. A manually shiftable member, also movable with the faceplate from the first position to the second position, is shiftable relative to the faceplate to hold the faceplate in the second position and, at the same time, to permit the dials to select a new opening combination of the lock. The faceplate constitutes a manual actuator that controls a latch.

15 Claims, 12 Drawing Figures

FRONT-PROGRAMMABLE COMBINATION LOCK WITH MOVABLE FACEPLATE

BACKGROUND OF THE INVENTION

This invention relates to combination locks and is more particularly concerned with front-programmable combination locks having spring-returned manual actuators.

Multiple-dial combination locks that permit a user to select a new opening combination of the lock by a programming operation at the front panel or faceplate of the lock are now well known. See, for example, U.S. Pat. Nos. 4,123,923 and 4,389,863, assigned to the assignee of the present invention. The locks of these patents have a spring-returned manual actuator that is movable relative to the faceplate and to the dials from a latching position to an unlatching position when the dials have been set to the opening combination of the lock. In another type of combination lock, disclosed in U.S. Pat. No. 3,952,561, and also assigned to the assignee of the present invention, the manual actuator and the faceplate of the lock are integral, and the faceplate and the dials form part of an assembly that moves between the latching and unlatching positions with a deadbolt action, i.e., without spring return. The integration of the faceplate and the manual actuator makes possible a combination lock that is functionally and esthetically desirable. However, in the combination lock of the last-mentioned patent, to select a new opening combination the user must manipulate a shift member that protrudes from the back cover of the lock, contrary to the recent trend toward front-programmable combination locks.

BRIEF DESCRIPTION OF THE INVENTION

The present invention provides a front-programmable combination lock in which the manual actuator is integral with the faceplate and in which the dials move with the faceplate between a latching position and an unlatching position. The invention also provides a combination lock having a spring-returned manual actuator that is held in an unlatching position in response to manual shifting of a shift member that enables the combination dials to select a new opening combinatin of the lock.

In one of its broader aspects, a combination lock of the invention comprises a casing including a fixed portion and a movable faceplate, a plurality of combination members supported for movement with the faceplate, and also for combination setting movement relative to the faceplate, means for preventing movement of the faceplate in a predetermined direction until the combination members have been set to an opening combination of the lock and for thereupon permitting such movement, and manually shiftable means movable with the faceplate, and also shiftable relative to the faceplate for enabling the combination members to select another opening combination of the lock.

In another of its broader aspects, a combination lock of the invention comprises a plurality of combination members movable to set an opening combination of the lock, actuator means manually movable from a first position to a second position only when the opening combination has been set, and a single manually shiftable member, the shifting of which in a predetermined direction simultaneously retains the actuator means in the second position and enables the combination members to select another opening combination of the lock.

The invention will be further described in conjunction with the accompanying drawings, which illustrate a preferred (best mode) embodiment of the invention.

DETAILED DESCRIPTION OF THE INVENTION

Figure 1:
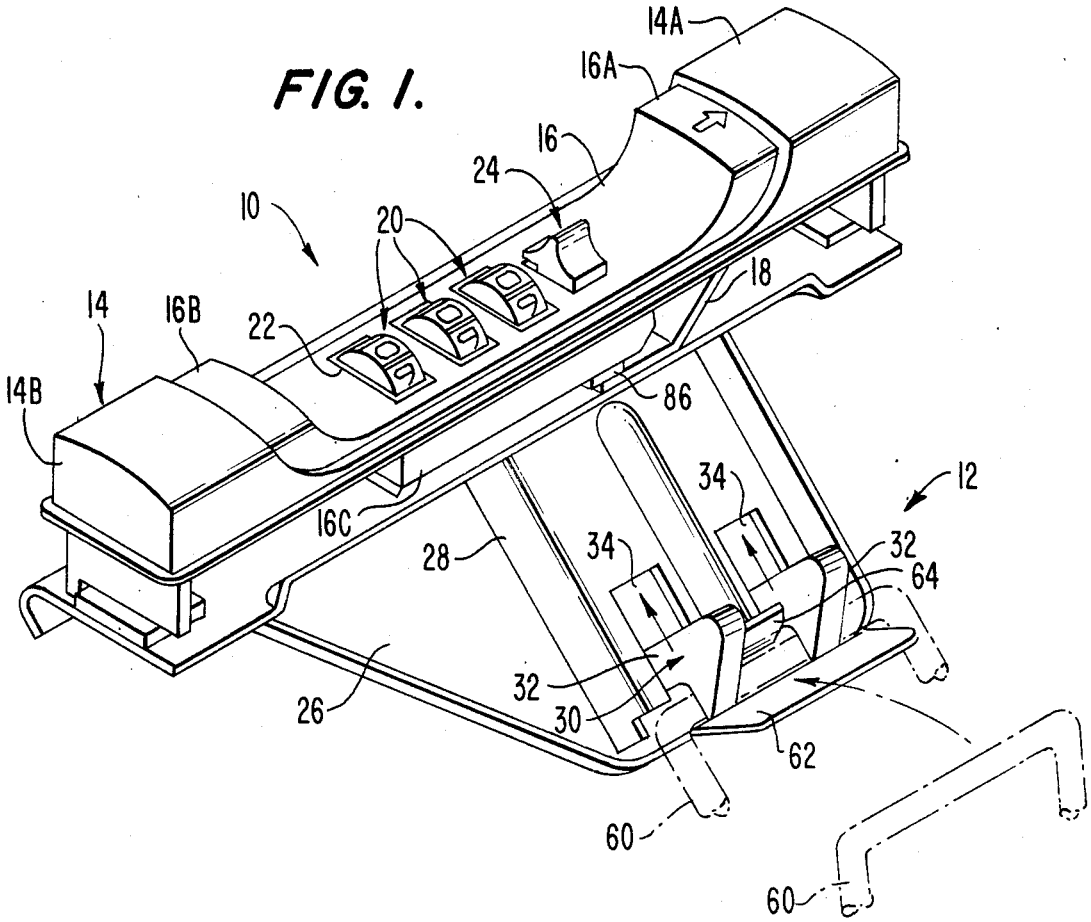
FIG. 1 is a perspective view illustrating a combination lock in accordance with the invention in conjunction with a latching device.

In FIG. 1 of the drawings, a combination lock 10 of the invention is shown operatively associated with a latching device 12. The latching device illustrated is merely representative of a type of device that may be controlled by the combination lock of the invention and forms no part of the invention. The combination lock comprises a casing 14 having a faceplate 16 and a back cover or frame 18, a plurality of settable combination members 20 in the form of coaxial indicia-bearing dials, peripheral portions of which are exposed through slots 22 in the faceplate for manual engagement, and a manually operable shift member 24 utilized in selecting a new opening combination of the lock. The shift member is located adjacent to one of the combination dials so that it may be conveniently operated by the user of the lock. The faceplate 16 preferably has a dished configuration, with upraised portions 16A and 16B at the ends fitting into corresponding fixed end portions 14A and 14B of the casing, and with depending side walls 16C. The faceplate is mounted between the end portions 14A, 14B and the frame 18 of the casing for longitudinal reciprocation. See FIGS. 6–8, 9 and 10.

In the form shown, the latching device 12 comprises an angulated plate 26 on which the lock casing 14 is mounted, as by screws or rivets (not shown). Plate 26 supports a rectangular housing 28 in which a latch 30 is supported for reciprocation. The latch may comprise a pair of hooks 32 projecting through slots 34 in the housing 28 and formed integrally with an open-backed box-shaped plate member 36 (see FIG. 4). Plate member 36 has a channel 38 containing a coil compression spring 40 for biasing the latch 30 to the position illustrated in FIGS. 1 and 4. One end of the spring 40 engages the inner surface of the lower end wall 42 of the plate 36, and the other end of the spring extends outwardly through an open end of the channel 38 to engage an abutment 44 on the plate 26.

Figure 4:
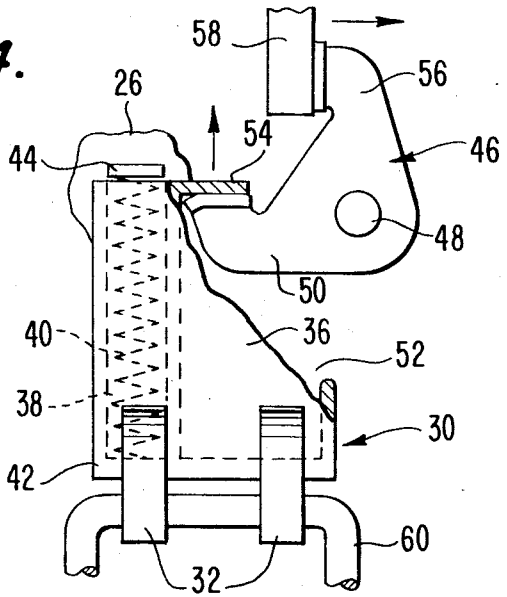
FIG. 4 is a fragmentary elevation view, partly broken away, further illustrating the manner in which the combination lock operates the latching device.

The latch 30 is moved against the bias of the spring 40 by a bell crank 46 having a central pivot 48 on the plate 26. One arm 50 of the bell crank enters a slot 52 in the plate member 36 to engage the inner surface of an upper wall 54 of the plate member 36, as shown in FIG. 4, and the other arm 56 engages a bar 58 projecting from the faceplate 16 of the lock through a slot (not shown) in the plate 26 of the latching device. Movement of the bar 58 in the direction of the adjacent arrow in FIG. 4 (in a manner to be described) turns the bell crank about the pivot 48 and moves the latch 30 in the direction of the arrow adjacent to wall 54. This movement, also indicated in FIG. 1 by arrows adjacent to the hooks 32, is effective to release the bail 60 of a hasp, for example. As shown in FIG. 1, the bail 60 may be retained against the plate 26 by the hooks 32 and may be guided into position against the plate 26 by cooperable converging lips 62 and 64 integral with the plate 26 and the housing 28, respectively.

The outwardly facing surfaces of the hooks 32 may be tapered as shown to permit the hooks to be lifted when the bail 60 is inserted between the lips 62 and 64, after which the hooks snap down to trap the bail. This action occurs independently of the combination lock, since it is apparent in FIG. 4 that the bell crank 46 can turn clockwise independently of the bar 58. The structure shown in FIG. 1 may be used to control the latching and locking of a glove compartment door of an automobile, for example, the lock and latching device being mounted on the dash and the bail 60 being attached to the door or lid of the glove compartment.

Figure 2:
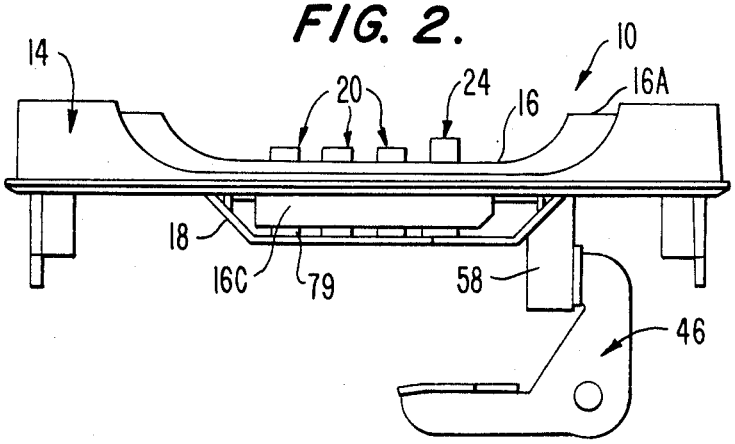
FIGS. 2 and 3 are side elevation views illustrating the manner in which the combination lock operates a latch control member.
Figure 3:
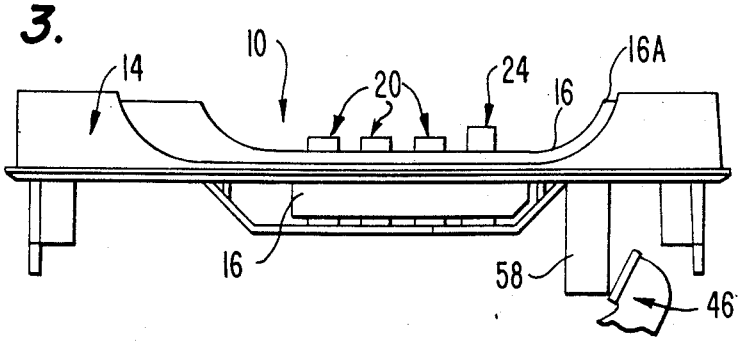

In accordance with the invention, the faceplate 16, dials 20, and shift member 24 form part of an assembly that is movable as a unit between the positions illustrated in FIGS. 2 and 3. The position of FIG. 2 will be termed the latching position, and the position of FIG. 3 the unlatching position. In the preferred form of the invention, the upraised end 16A of the faceplate 16 constitutes a manual actuator (sometimes referred to as a "puller"). End 16A of the faceplate may be engaged by the user's thumb, for example, and pressed rightwardly in FIG. 2 to move the manual actuator to the position of FIG. 3. When the manual actuator is moved to the position of FIG. 3, the bell crank 46 is turned and operates the latching device as described earlier.

Figure 7:
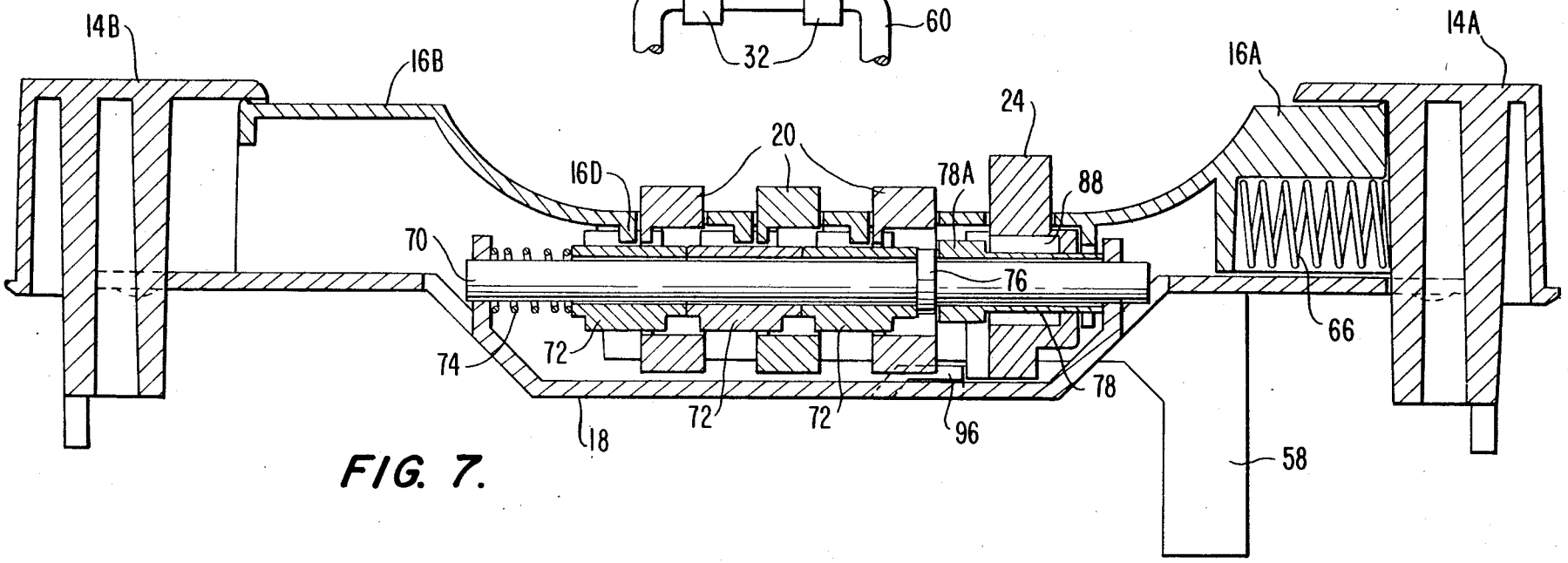
FIGS. 7 and 8 are views similar to FIG. 6, but showing different operative postions of the lock mechanism.
Figure 6:
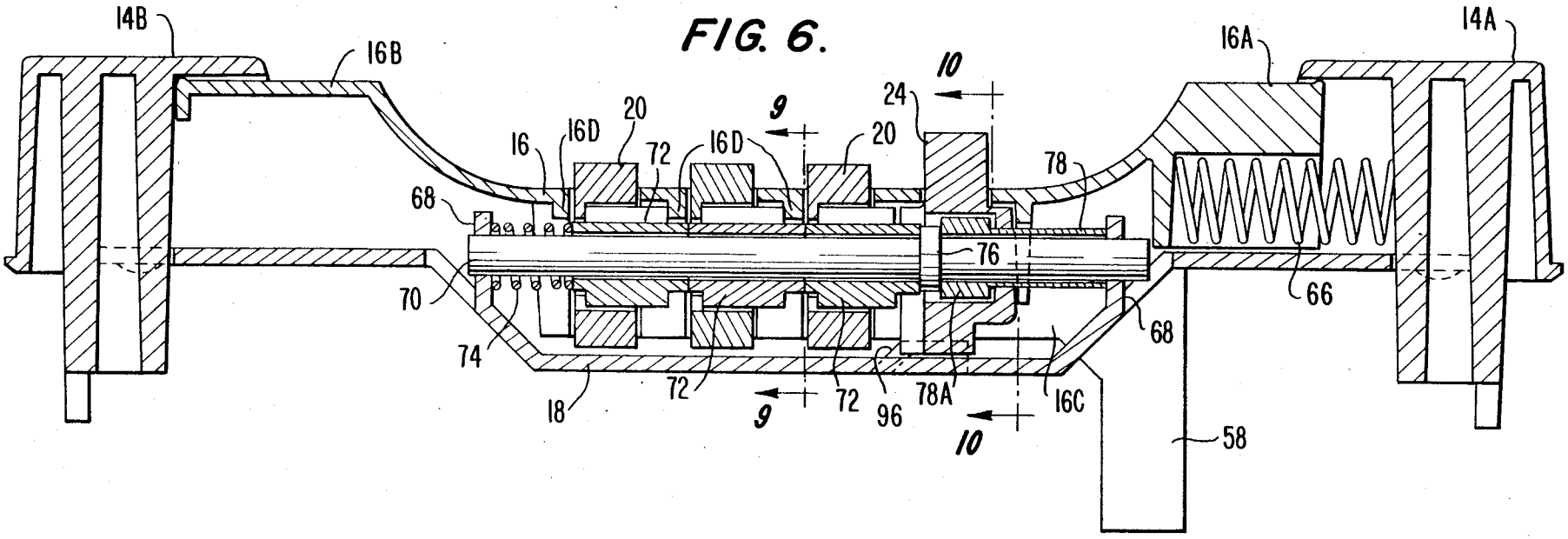
FIG. 6 is a longitudinal sectional view taken along line 6—6 of FIG. 5.

FIGS. 6 and 7 correspond to FIGS. 2 and 3, respectively, and illustrate the mechanism of the combination lock in greater detail. As shown, a coil spring 66 biases the manual actuator 16A to the latching position of FIG. 6 and is compressed when the manual actuator is moved to the unlatching position of FIG. 7. The manual actuator is then spring-returned.

Figure 9:
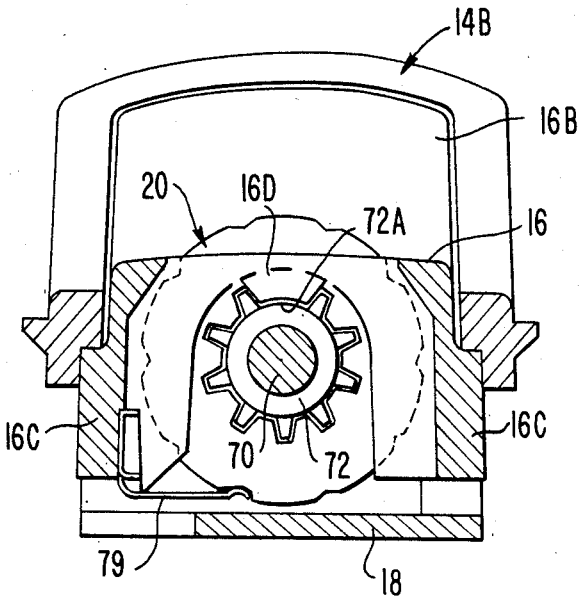
FIGS. 9 and 10 are transverse sectional views taken along lines 9—9 and 10—10, respectively, in FIG. 6.

The frame 18 is provided with a pair of bosses 68 having openings for mounting a shaft 70. The shaft supports a series of sleeves 72 in end-to-end abutment between a coil compression spring 74 and a collar 76. A tubular spacer 78 fills the space between an adjacent boss 68 and the collar 76. Each of the sleeves 72 supports one of the dials 20. As shown in FIG. 9, each sleeve 72 has an external gear configuration, and each dial 20 has a complementary internal gear configuration at one end of the dial (see FIG. 6) whereby the sleeves are normally coupled to the dials for rotation therewith. As shown in FIG. 9, each sleeve has a missing tooth portion 72A which is complementary to a wedge-shaped abutment 16D extending inwardly from the faceplate 16 adjacent to the corresponding sleeve. Also shown in FIG. 9 is a conventional dial spring 79, the arms of which engage spaced notches in the periphery of the dials for indexing the dials as they are turned.

When each of the dials is turned to an appropriate rotational position to set the opening combination of the lock (displayed on the exposed peripheral portions of the dials as shown in FIG. 1), the sleeves 72 will have rotational positions at which the missing tooth portions 72A will be aligned with the corresponding wedge-shaped abutments 16D, so as to permit the abutments (and hence the manual actuator 16A) to move longitudinally of the lock relative to the sleeves, i.e., to permit the abutments to bypass the sleeves. However, if any of the dials is not set to its opening combination position, a tooth of the corresponding sleeve 72 will interfere with the corresponding wedge-shaped abutment 16D, and logitudinal movement of the manual actuator 16A from the latching position of FIG. 6 to the unlatching position of FIG. 7 will be prevented. Thus movement of the manual actuator from the latching position to the unlatching position can only occur when the dials 20 have been set to the opening combination of the lock.

As is apparent from FIGS. 6 and 7, the longitudinal extent of the gear teeth of the sleeves 72 is sufficient to maintain the coupling of the dials to the sleeves irrespective of whether the manual actuator is in the position of FIG. 6 or the position of FIG. 7. Thus the dials cannot be turned without also turning the sleeves and thereby modifying the combination setting. There are occasions, however, in which the user may wish to select a new opening combination of the lock. In accordance with the invention, this is accomplished by operation of the shift member 24 and subsequent turning of the dials 20 independently of the sleeves 72 to the desired new combination.

Figure 10:
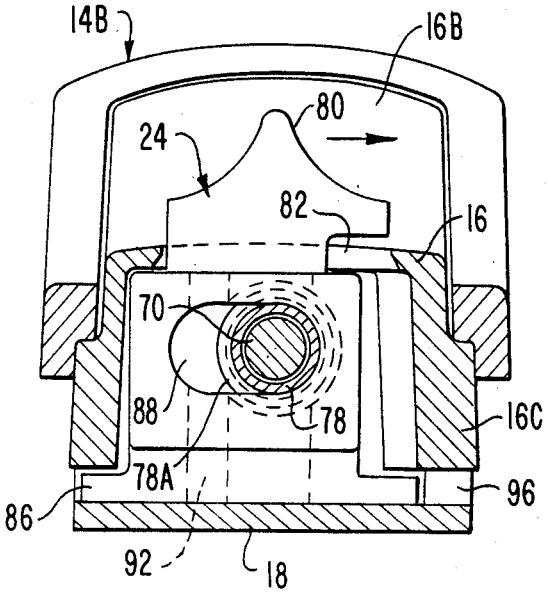
Figure 11:
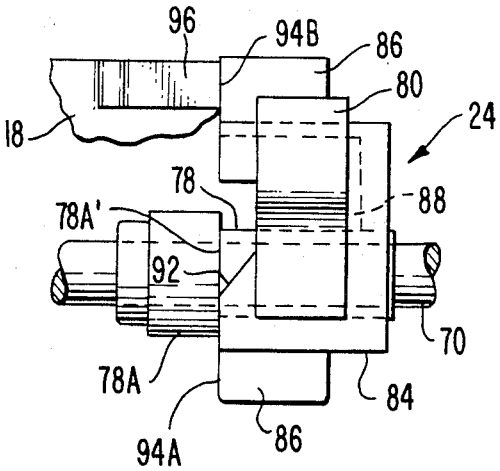
FIG. 11 is a fragmentary top plan view illustrating the operation of a shift member employed in the invention.
Figure 12:
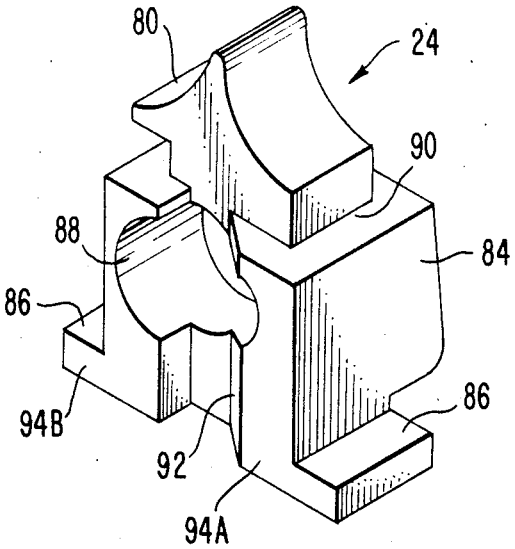
FIG. 12 is a perspective view of the shift member.

As shown in FIGS. 10 and 12, the shift member 24 is a block-like structure having a peaked manually engageable portion 80 that protrudes through a slot 82 in the faceplate 16 and that is integral with the main body 84 of the shift member. The shift member has a base portion 86 slidable along the frame 18 and has an elongated opening 88 through which the shaft 70 and tubular spacer 78 pass. A slot 90 between protruding portion 80 and the main body 84, together with the slot 88, permits the shift member to be moved laterally of the shaft 70, as is evident in FIG. 10. The body of the shift member has a camming surface 92 inclined to the axis of the shaft 70 (see FIG. 11) and end surfaces 94A, 94B perpendicular to the axis of the shaft.

Figure 5:
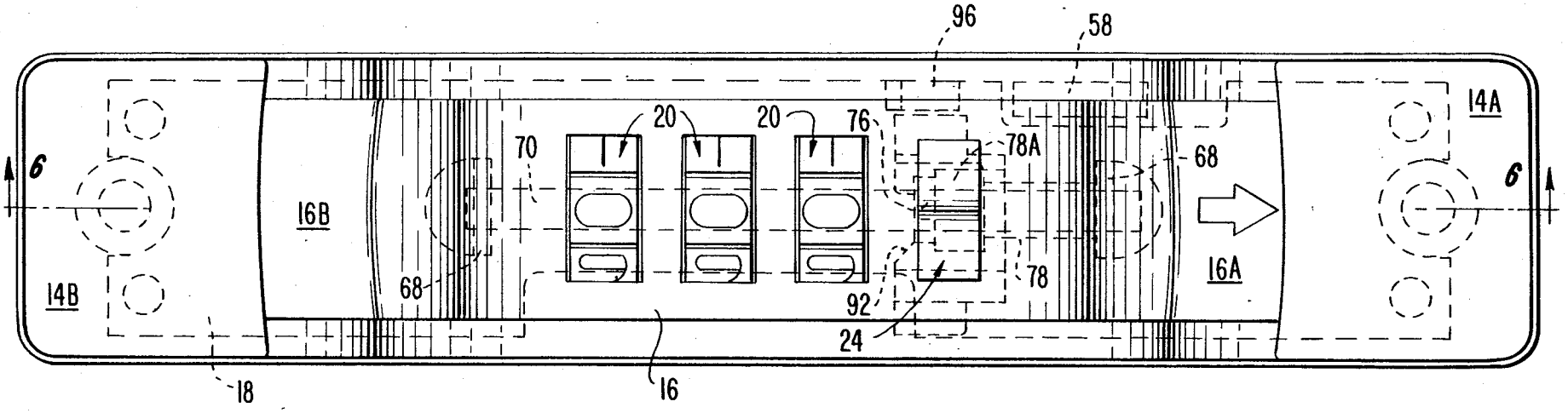
FIG. 5 is a top plan view of the combination lock of the invention.
Figure 8:
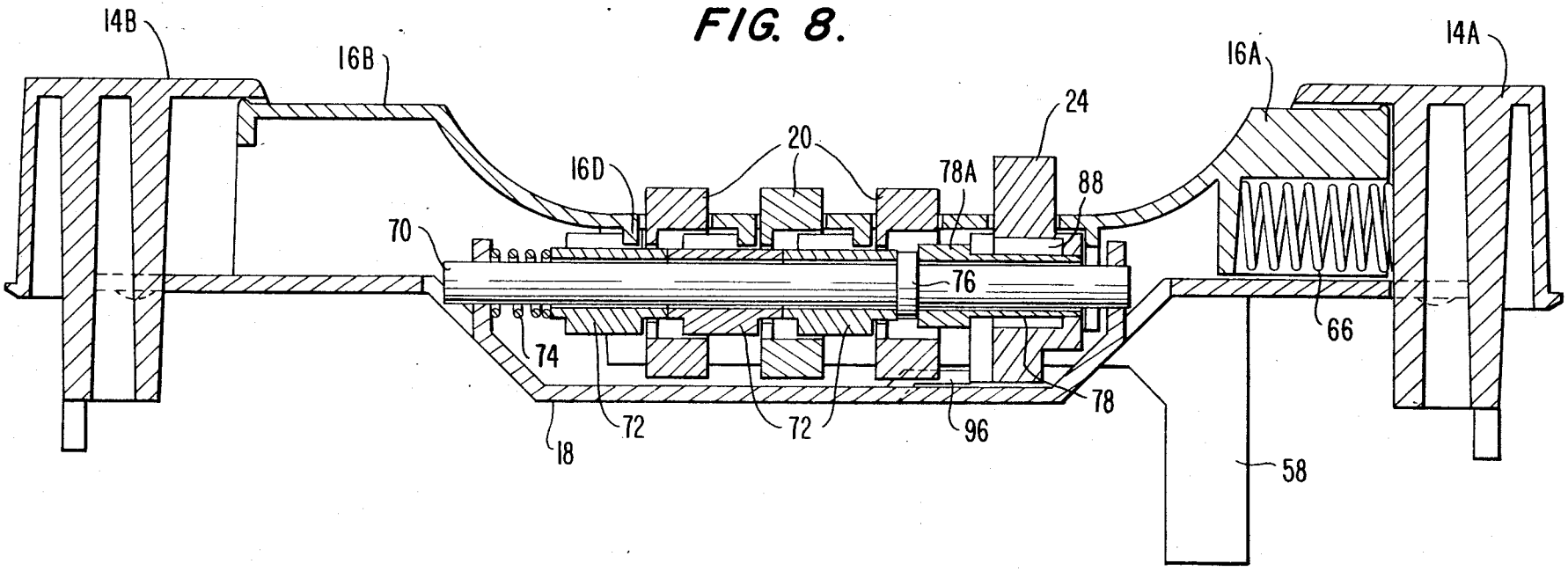

As is apparent in FIGS. 5 and 6, the tubular spacer 78 has an enlarged head 78A that fits within the opening 88, which is enlarged at one end of the shift member to receive the head 78A. When the manual actuator 16A is moved to the unlatching position, as shown in FIG. 7, the shift member 24 moves with the manual actuator, while the tubular spacer 78 remains stationary, along with sleeves 72, so that the head 78A is withdrawn from the opening 88. If the user now moves the shift member 24 in the direction of the arrow in FIG. 10, the inclined camming surface 92 of the shift member engages the adjacent radially directed surface 78A' of the head 78A (see FIG. 11), forcing the tubular spacer 78 to move (leftwardly) from the position of FIG. 7 to the position of FIG. 8, thereby moving the collar 76 (on the shaft 70) and the sleeves 72 concurrently, so as to withdraw the external gear teeth of the sleeves from the internal gear teeth of the dials, compressing spring 74 as shown in FIG. 8, and freeing the dials for rotation independently of the sleeves. As shown in FIG. 11, the end surface 94A of the shift member comes into abutment with the radially directed surface 78A' of the head 78A, so that the shift member and the head will retain their mutual positions until the user physically moves the shift member in the direction opposite to the arrow in FIG. 10, whereupon spring 74 will expand and re-couple the sleeves 72 with the dials 20.

It is desirable that the selection of a new opening combination be permitted only when the combination lock is in the unlatching position (FIG. 7). Otherwise, someone might change the opening combination of the lock with the manual actuator in the latching position and fail to note the new opening combination before scrambling the dials. This would prevent further opening of the lock without a laborious procedure to determine the new opening combination.

In accordance with the invention, the shift member 24 is incapable of enabling the selection of a new opening combination when the manual actuator is in the latching position (FIG. 6). Moreover, the shifting of the shift member after the manual actuator has been moved to the unlatching position (FIG. 7) retains the manual actuator in that position until the shift member is returned by the user to its normal rest position. For these purposes, the frame 18 is provided with an abutment 96 along one longitudinal edge thereof. When the manual actuator is in the latching position of FIG. 6, any attempt to shift the shift member 24 in the direction of the arrow in FIG. 10 causes the base portion 86 of the shift member to strike the abutment 96, which prevents shifting of the shift member. However, when the manual actuator has been moved to the unlatching position of FIG. 7, the base portion 86 of the shift member has been moved longitudinally beyond the abutment 96, freeing the shift member for movement in the direction of the arrow in FIG. 10. Moreover, when the shift member has been so moved, the end surface 94B of the shift member engages a corresponding end surface of the abutment 96, as shown in FIG. 11, holding the manual actuator 16A in the unlatching position of FIGS. 7 and 8, against the bias of return spring 66. Thus the single shift member 24 performs two functions concurrently. First it retains the manual actuator in the unlatching position, and second, it enables the user to select a new opening combination.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. A combination lock comprising a casing including a fixed portion and a movable faceplate, a plurality of combination members supported for movement with the faceplate, and also for combination setting movement relative to the faceplate, means for preventing movement of the faceplate in a predetermined direction until the combination members have been set to an opening combination of the lock and for thereupon permitting such movement, and manually shiftable means movable with the faceplate, and also shiftable relative to the faceplate for enabling the combination members to select another opening combination of the lock.

2. A combination lock in accordance with claim 1, wherein the combination members are dials and wherein said preventing means comprises sleeves normally coupled to respective dials for rotation therewith, and wherein shifting of said manually shiftable means uncouples the sleeves from the dials and thereby enabling the dials to turn independently of the sleeves.

3. A combination lock in accordance with claim 2, wherein the manually shiftable means is shiftable to uncouple the sleeves from the dials only when the faceplate has been moved in said predetermined direction from a latching position to an unlatching position.

4. A combination lock in accordance with claim 3, further comprising spring means for biasing said faceplate to said latching position, and wherein said manually shiftable means has means for retaining said faceplate in said unlatching position against the bias of said spring means.

5. A combination lock in accordance with claim 4, wherein said retaining means comprises cooperable surfaces of said manually shiftable means and a fixed portion of said casing.

6. A combination lock in accordance with claim 4, wherein said manually shiftable means has a manually engageable portion adjacent to one of said dials and movable in a direction transverse to said predetermined direction.

7. A combination lock in accordance with claim 2, wherein said preventing means further comprises abutments on said faceplate engageable with said sleeves, except when said dials are set to the opening combination of the lock, for preventing movement of said faceplate in said predetermined direction relative to said sleeves.

8. A combination lock in accordance with claim 7, wherein said sleeves are arranged in end-to-end abutment on a shaft and are held coupled with respective dials by spring means, and wherein said manually shiftable means has cam means for moving said sleeves axially of the shaft against the bias of said spring means to uncouple the sleeves from the dials.

9. A combination lock in accordance with claim 8, wherein said manually shiftable means has means for retaining the position thereof after manual shifting.

10. A combination lock comprising a plurality of combination members movable to set an opening combination of the lock, actuator means manually movable along a first predetermined direction from a first position to a second position only when the opening combination of the lock has been set, and a single manually shiftable member, the shifting of which relative to said actuator means along a second predetermined direction simultaneously retains the actuator means in the second position and enables the combination members to select another opening combination of the lock.

11. A combination lock in accordance with claim 10, further comprising means for biasing said actuator means toward said first position.

12. A combination lock in accordance with claim 10, wherein said manually shiftable member is supported for movement with said actuator means between said first and second positions and wherein said second direction is transverse to said first direction.

13. A combination lock in accordance with claim 12, wherein said combination members are supported for movement with said actuator means between said first and second positions.

14. A combination lock in accordance with claim 10, wherein said actuator means comprises a faceplate of the lock and wherein said combination members and said manually shiftable member are exposed for manual engagement through openings in said faceplate.

15. A combination lock in accordance with claim 14, wherein said combination members comprise dials, each normally coupled to a sleeve for rotation therewith, said faceplate and said sleeves having cooperable means for preventing movement of said faceplate from said first position to said second position except when said sleeves have a predetermined rotational position, and wherein shifting of said manually shiftable member uncouples said sleeves from said dials.

* * * * *